United States Patent [19]

Roop

[11] Patent Number: 4,617,811

[45] Date of Patent: Oct. 21, 1986

[54] MECHANISM FOR OPERATING A DROP-BOLT DOOR LOCK

[75] Inventor: Stevie C. Roop, Dugspur, Va.

[73] Assignee: Medeco Security Locks, Inc., Salem, Va.

[21] Appl. No.: 637,589

[22] Filed: Aug. 3, 1984

[51] Int. Cl.[4] ..... E05B 63/12

[52] U.S. Cl. ..... 70/131; 70/150; 292/150

[58] Field of Search ..... 70/124, 129, 130, 131, 70/134, 136, 142, 150, 151 R; 292/150

[56] References Cited

U.S. PATENT DOCUMENTS

| | | | |
|---|---|---|---|
| 1,065,848 | 6/1913 | Segal . | |
| 1,212,823 | 1/1917 | Segal | 70/104 |
| 1,404,556 | 1/1922 | Sprung | 70/130 |
| 1,546,644 | 7/1925 | Freysinger | 70/130 |
| 1,922,043 | 8/1933 | Hines | 292/133 |
| 2,666,661 | 1/1954 | Segal | 70/131 |
| 3,746,380 | 7/1973 | Kartarik | 292/117 |
| 3,760,619 | 9/1973 | Colombo | 70/104 |
| 4,061,383 | 12/1977 | Waldo | 292/335 |

FOREIGN PATENT DOCUMENTS

| | | | |
|---|---|---|---|
| 56791 | 12/1974 | Australia | 70/131 |

*Primary Examiner*—Robert L. Wolfe
*Attorney, Agent, or Firm*—Bernard, Rothwell & Brown

[57] ABSTRACT

A mechanism for smoothly and reliably operating a drop-bolt lock in which the drop-bolt operating mechanism includes a slidable bolt member carrying a cross slidable biased actuator member operable by cams for smooth sliding operation. Guide rails guide the sliding movement of the bolt member and the actuator member it carries, but the guides include a stop for cooperating with a lug on the actuator member to stop movement of the bolt unless and until the actuator member is forced away from the stop.

5 Claims, 7 Drawing Figures

FIG. 1
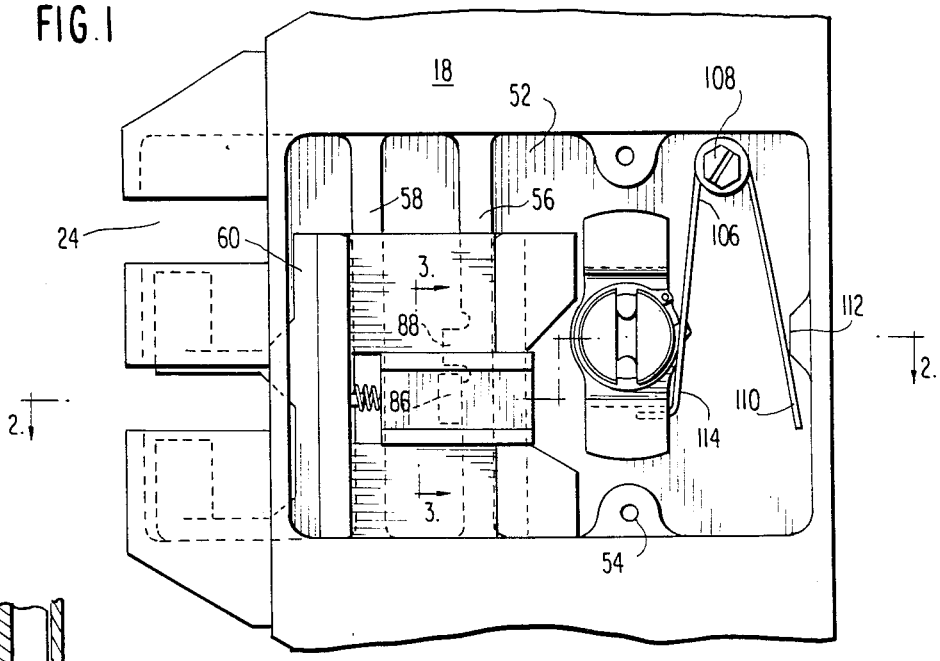
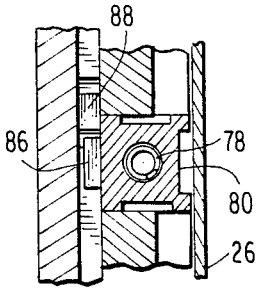
FIG. 3
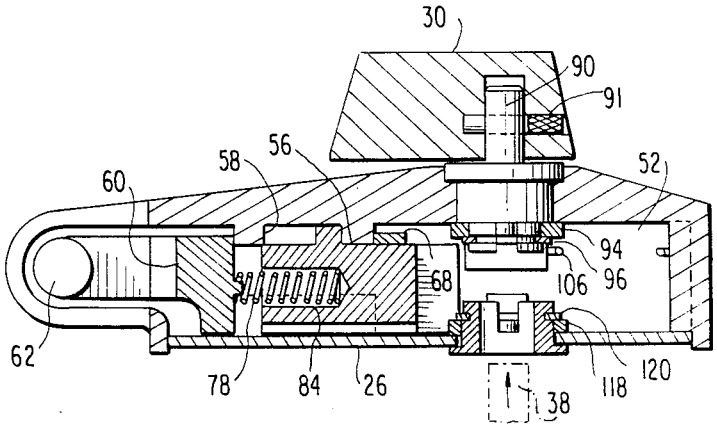
FIG. 2
FIG. 4
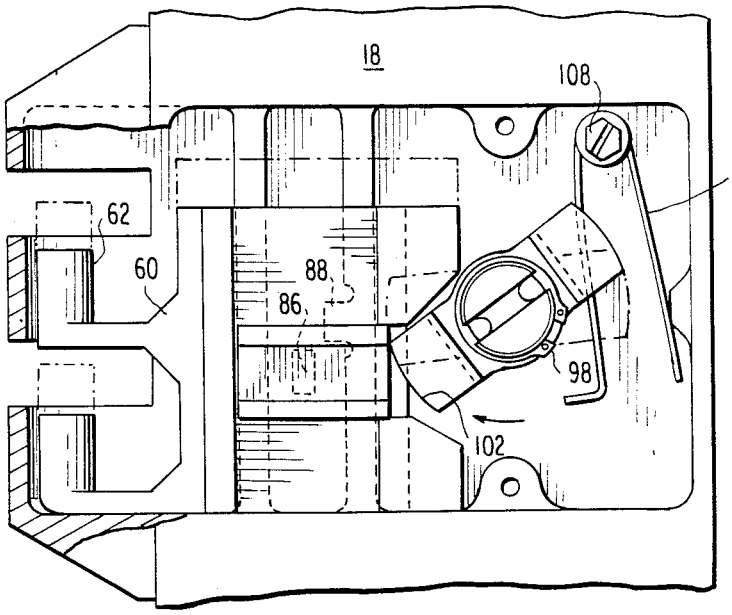

MECHANISM FOR OPERATING A DROP-BOLT DOOR LOCK

BACKGROUND OF THE INVENTION

1. Field of the Invention

This invention relates to improvements in mechanisms for operating drop-bolt-type lock assemblies.

2. Prior Art

It is known in the art that drop-bolt locks (also known as vertical dead bolts) provide extremely good resistance to defeat by jimmying, chiseling, prying and the like.

Drop-bolt locks of jimmy-proof construction utilizing a pair of rings on a strike or keeper for a pair of bolts operated by rotational action of a lock cylinder from either side of the door are also known in the art. Such are sold under the trademark Segalock by the New England Lock and Hardware Co. of South Norwalk, Conn. However, such locks leave something to be desired in the smoothness of the operability of the bolt as they are operated from a hinged pin and lever arrangement. For example, see U.S. Pat. No. 1,922,043 granted 1933. The components are not particularly easy to service as they will sometimes fly apart when attempting to disassemble.

SUMMARY OF THE INVENTION

This invention provides a unique operating mechanism for a drop-bolt which includes a unitary dual drop-bolt which is formed and machined to slide upon integral rails in the housing. A uniquely formed spring-biased drop-bolt actuator slides with the drop-bolt and also slides on the rails of the housing which rails have a stop to cooperate with the actuator. Cams operated from either the cylinder lock tang or the keyturn operate the sliding drop-bolt actuator. The mechanism is smooth-operating, reliable and easy to service.

BRIEF DESCRIPTION OF THE DRAWINGS

FIG. 1 is a rear elevation view of the mechanism for operating the drop-bolt with cover plate removed.

FIG. 2 is a sectional view taken along line 2—2 of FIG. 1.

FIG. 3 is a sectional view taken along line 3—3 of FIG. 1.

FIG. 4 is a rear elevation view similar to FIG. 1 with portions taken away showing partial operation of the lock in phantom line position.

Figure 5:
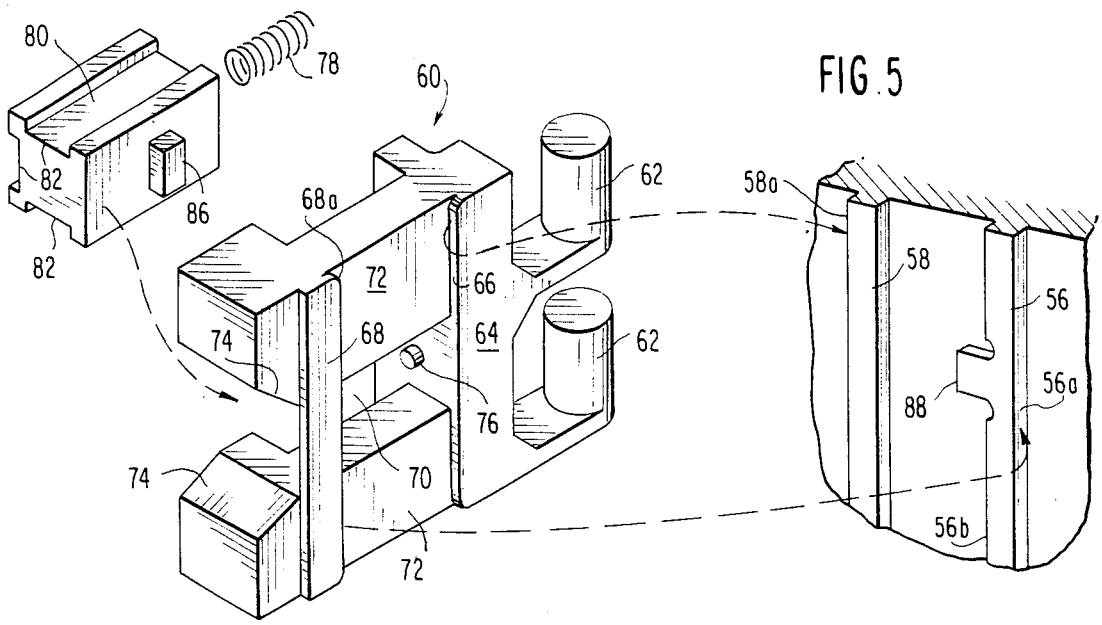
FIG. 5 is an exploded perspective view of portions of the lock housing, a locking bolt member, and an actuator member.

The preferred embodiment of the unique mechanism for operating the vertical dead-bolt smoothly and reliably is shown in FIGS. 1–7. An assembly arrangement of the drop-bolt, strike, and cylinder lock are shown in application Ser. No. 637,588 filed Aug. 3, 1984. The drop-bolt assembly includes a drop-bolt housing 18 having spaces 24 for the reception of rings on a striker or keeper as is known in the art and shown in the above-mentioned application. With reference to bolt housing 18 a depression forming a pocket 52 has screw receiving bosses 54 therein for receiving the screws which hold the cover plate 26 over the back of the housing. Guide rails 56 and 58 are integral in the housing 18 and extend vertically as shown in FIGS. 2 and 5. These guide rails guide the bolt during its locking and unlocking movement.

A locking bolt member 60 is shown in perspective in FIG. 5 and includes a pair of integral vertically-extending bolt pins 62 connected to a main body 64. There is a vertical guide edge 66 on the main body which when assembled in the housing 18 mates with edge 58*a* on guide rail 58. The main body 64 also includes a vertical guide rib 68 which has an edge surface 68*a* which mates with surface 56*a* of the guide rail 56. A central space 70 is provided between integral parallel legs 72 of the body 64. Each of these legs 72 has an inside tapered tip 74 to allow operation of an actuator from the cams. The bolt member 60 also has a spring guide post 76 for guiding of coil spring 78.

An actuator member 80 slides in the central space 70 of the locking bolt member and includes friction-reducing cut-outs 82 on three sides thereof, a blind hole 84 for seating spring 78 and a lug 86 which accomplishes a locking function.

Lug 86 slides on the edge surface 56*b* of guide rail 56 during travel of the bolt 60 and actuator 80. In approximately the center of the surface of the guide rail 56 there is an integral stop 88 which during normal vertical sliding movement of the actuator member 80 will stop such member by contacting the lug 86 as shown in FIG. 1. In order to actuate the lock the actuator member 80 must be moved toward the strike against the bias of the spring 76 until the lug 86 clears the stop 88, compare FIGS. 1 and 4.

Figure 6:
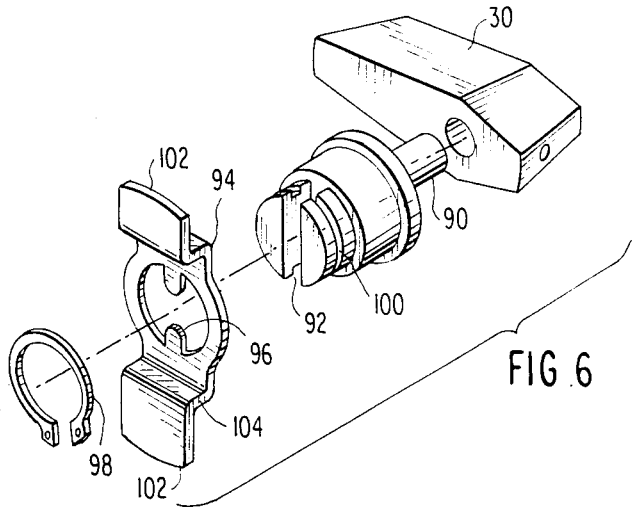
FIG. 6 is an exploded perspective view of the thumb-turn, thumb-turn shaft assembly.

The actuator member 80 may be actuated by cams operated either from a cylinder lock tang 38 or the thumb-turn 30. As shown in FIGS. 2 and 6 the thumb-turn 30 is attached to a thumb-turn shaft assembly 90 by a knurled pin 91. The thumb-turn shaft assembly is formed to fit into a hole in housing 18 and has a slotted face 92. A cam member 94 having internally-extending tangs 96 is slipped over the end of the thumb-turn shaft 90 and the tangs are held in slot 92. The cam is retained by means of a locking ring 98 which also slips over the end of the shaft and is held in peripheral groove 100. The cam 94 has offset cam arms 102 which are offset via spring ledge 104.

A torsion spring 106 is secured near its middle by a screw pin assembly 108. One leg 110 of the spring bears against a boss 112 on the inside of the housing 18 while the other leg 114 bears against the spring ledge 104 of the cam 94. The spring 106 thus assists in causing the thumb-turn to throw the bolt into either locked or unlocked position and not leave it in an intermediate position.

Figure 7:
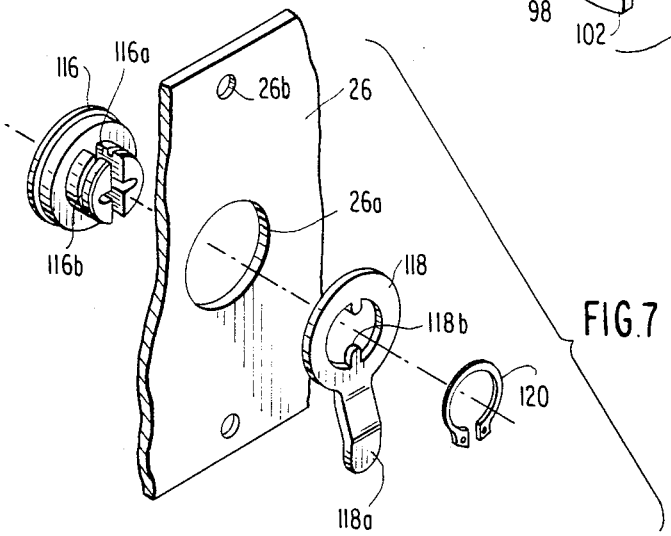
FIG. 7 is an exploded perspective view of the cover plate, cam adaptor and cam for the end of the lock tang.

With reference to operation of the actuator member 80 from the cylinder lock and extending tang 38, there is a cam adaptor 116, see FIG. 7 which extends through a hole 26*a* in cover plate 26. The cover plate also has smaller holes 26*b* for reception of screws. The cam adaptor receives the tang in one end and has a slotted face 116*a* on the other end which is inside the housing. A cam member 118 has a cam arm 118*a* and internal tangs 118*b* which tangs fit into the slot 116*a*. A locking ring 120 fitting in groove 116*b* is utilized to hold the cam 118 on the cam adaptor 116. Rotating of the tang 38 will rotate the cam arm 118*a*.

In operation, the cam arm 118*a* and cam arms 102 can be positioned by their rotation to contact the end of the actuator member 80 and force it toward the strike so that lug 86 will clear stop 88 to throw the bolt to a locking position, see FIG. 4. Similarly, when in locking position either the cam member 118 or a cam arm 102 can rotate in a counterclockwise direction viewed in FIG. 4 to again move the actuator member toward the strike 16 and against the compression of the spring 78 so as to throw the bolt to its unlocking position. Because of the integral guide rails guiding the sliding bolt and the actuator member sliding with the bolt the assembly is particularly strong, reliable and smooth operating.

The entire arrangement provides an extremely strong, easy to service, smooth acting, defeat-resistant drop-bolt lock mechanism not available with the known prior art constructions.

What is claimed is:

1. A high-security, defeat-resistant vertical drop-bolt lock operating assembly, the assembly being of the type including a vertical drop-bolt member, an operating mechanism for operating the bolt member and a housing for the operating mechanism, the improvements comprising:

(a) guide rail means extending vertically within the housing, (b) means on the bolt member cooperating with the guide rail means so that the bolt member is slidable vertically on the guide rail means, (c) an actuator member carried by the bolt member and slidable vertically with the bolt, the actuator member also slidable transversely and horizontally within the bolt member, (d) locking means cooperating between the actuator member and the guide rail means to stop vertical movement of the bolt member and the actuator member in either direction unless the actuator member is moved horizontally and transversely with regard to the movement of the bolt, (e) cam means contacting the actuator member for moving the actuator member horizontally transversely of the bolt member movement and for sliding the bolt from locking to unlocking position and vice versa.

2. A lock assembly as in claim 1 further comprising means for normally biasing the actuator member to a position to prevent sliding of the bolt from locked to unlocked position or vice versa, and a torsion spring means normally biasing the cam means.

3. A lock assembly as in claim 1, the cam means including two cams one operable from one side of the housing and the other operable from the other side of the housing.

4. A lock assembly as in claim 1 wherein the cam means is biased by a torsion spring and connected to a thumb screw operator.

5. A lock assembly as in claim 1 wherein the drop-bolt member includes a pair of integral bolt pins which cooperate with a pair of rings on a strike, and wherein said locking means include a stop on the guide rail means for stopping movement of the actuator member by contacting a lug on the actuator member.

* * * * *